United States Patent [19]

Haines

[11] Patent Number: 5,074,357

[45] Date of Patent: Dec. 24, 1991

[54] PROCESS FOR IN-SITU ENRICHMENT OF GAS USED IN MISCIBLE FLOODING

[75] Inventor: Hiemi K. Haines, Englewood, Colo.

[73] Assignee: Marathon Oil Company, Findlay, Ohio

[21] Appl. No.: 457,679

[22] Filed: Dec. 27, 1989

[51] Int. Cl.[5] ..... E21B 43/00

[52] U.S. Cl. ..... 166/267; 166/268

[58] Field of Search ..... 166/267, 263, 265, 370

[56] References Cited

U.S. PATENT DOCUMENTS

| | | | |
|---|---|---|---|
| 2,217,749 | 10/1940 | Hewitt | 166/166 |
| 2,875,830 | 3/1959 | Martin | 166/266 |
| 2,875,832 | 3/1959 | Martin et al. | 166/266 |
| 3,254,712 | 6/1966 | Sharp | 166/166 |
| 3,442,332 | 5/1969 | Keith | 166/267 |
| 3,811,501 | 5/1974 | Burnett et al. | 166/252 |
| 3,811,503 | 5/1974 | Burnett et al. | 166/252 |
| 3,871,451 | 3/1975 | Brown | 166/267 |
| 3,995,693 | 12/1976 | Cornelius | 166/268 |
| 4,224,992 | 9/1980 | Comberiati et al. | 166/263 |
| 4,299,286 | 11/1981 | Alston | 166/274 |
| 4,343,362 | 8/1982 | Turta et al. | 166/267 |
| 4,512,400 | 4/1985 | Simmon | 166/245 |
| 4,529,037 | 7/1985 | Froning et al. | 166/266 |
| 4,557,330 | 12/1985 | Fussell et al. | 166/274 |
| 4,558,740 | 12/1985 | Yellig, Jr. | 166/272 |
| 4,610,160 | 9/1986 | Christiansen | 73/151 |
| 4,617,996 | 10/1986 | Shu | 166/273 |
| 4,628,999 | 12/1986 | Kiss et al. | 166/274 |
| 4,643,252 | 2/1987 | Kovarik | 166/263 |
| 4,664,190 | 5/1987 | Carpentier | 166/267 |
| 4,678,036 | 7/1987 | Hartman et al. | 166/273 |
| 4,774,417 | 5/1988 | Alameddine | 166/245 |
| 4,846,276 | 7/1989 | Haines | 166/273 |

OTHER PUBLICATIONS

Improved Oil Recovery, Chapter IV-Carbon Dioxide Flooding, pp. 113-120, IOCC, Oklahoma City, OK.

Stalkup, F. I., Miscible Displacement, SPE Monograph, vol. 8, Society of Petroleum Engineers, pp. 14-18.

Latil, M., Bardon, C., Burgev, J. and Sourieau, P., Enhanced Oil Recovery, Sec. 76.3-77, Gulf Pub. Co., pp. 219-225 (1980).

Stalkup, F. I., "Carbon Dioxide Miscible Flooding: Past, Present, and Outlook for the Future", Journal of Petroleum Technology, Aug. 1978, pp. 1104-1112.

*Primary Examiner*—Ramon S. Britts

*Assistant Examiner*—Roger J. Schoeppel

*Attorney, Agent, or Firm*—Jack L. Hummel; Jack E. Ebel

[57] ABSTRACT

A process for in-situ enrichment of gas used in miscible flooding in a subterranean hydrocarbon-bearing reservoir. A drive gas such as methane, lean natural gas, nitrogen, carbon dioxide or mixtures thereof is used to immiscibly displace formation hydrocarbons. After gas breakthrough the produced fluid is separated into oil and gas components. The separated gas, which has been enriched with intermediate hydrocarbon compounds extracted from the formation hydrocarbons, is mixed with the drive gas injected into the reservoir so as to enrich the injected gas sufficiently to cause miscible displacement of the formation hydrocarbons. When the drive gas is carbon dioxide, methane and/or nitrogen may be extracted from the separated gas prior to being mixed with the drive gas.

6 Claims, 1 Drawing Sheet

10
12
14
16
18
20
24
26
28
30

PROCESS FOR IN-SITU ENRICHMENT OF GAS USED IN MISCIBLE FLOODING

FIELD OF THE INVENTION

The present invention relates to the preparation of gases used in the miscible flooding of a subterranean hydrocarbon-bearing formation, and more particularly, to a process for in-situ enrichment of a gas to improve the miscibility of the gas and hydrocarbons present in a subterranean hydrocarbon-bearing formation.

BACKGROUND OF THE INVENTION

It is well known to inject miscible gases into a subterranean hydrocarbon-bearing reservoir to improve production of hydrocarbons from the formation through miscible flooding. Miscible flooding occurs when a gas injected into the formation mixes with hydrocarbons in the formation at the ambient temperature and pressure of the formation to displace the hydrocarbons. This phenomenon occurs as a result of intermediate hydrocarbon compounds in the injected gas condensing upon contact with the formation hydrocarbons and altering the composition of the formation hydrocarbons. If sufficient amounts of hydrocarbon intermediates condense from the gas and mix with the formation hydrocarbons, the flooding gas and formation hydrocarbons become miscible. This phenomenon is referred to as the condensing mechanism. The injected gas may also become miscible with the formation hydrocarbons through the vaporizing mechanism in which intermediate hydrocarbons are vaporized from formation hydrocarbons into the injected gas, thus creating miscibility. Flooding a subterranean formation with a gas which is miscible with hydrocarbons present in the formation versus a gas which is immiscible with these hydrocarbons can result in recovery of up to about 10–15 volume, % of incremental hydrocarbons in place in the formation.

A process for miscibly flooding a subterranean formation utilizing a gas, such as carbon dioxide, methane, or nitrogen, which does not contain intermediate hydrocarbons and which is capable of extracting or vaporizing formation hydrocarbons so that the gas becomes enriched with extracted formation hydrocarbons is conducted by raising the operating pressure of the flooding process so as to reach the minimum miscibility pressure, that is, the minimum pressure at which the gas is miscible in the formation hydrocarbons. The process of miscible flooding can also be conducted by enriching the gas with hydrocarbon intermediates prior to injecting the gas into the subterranean formation. The resulting enriched gas is a multicomponent gas containing sufficient hydrocarbon intermediates to render the enriched gas substantially miscible in formation hydrocarbons upon injection into the formation.

An example of one type of enrichment process is found in U.S. Pat. No. 4,529,037 which discloses the formation of a drive gas comprised of carbon dioxide and intermediate hydrocarbons. A surface facility is employed to maintain multiple phase mixtures of crude oil and carbon dioxide in an extraction zone from which it is withdrawn for subsequent injection into a reservoir. The cost of the necessary facilities to extract hydrocarbons and mix the extracted hydrocarbons with a drive gas can, however, be prohibitively expensive for some reservoirs.

In order to reduce the cost of drive gas preparation it has been suggested to utilize the mixing that takes place in the reservoir to create an enriched gas. U.S. Pat. No. 2,875,832, for example, discloses a process which involves introducing carbon dioxide into the oil reservoir and recycling the gaseous effluent back into the formation. Because the process requires the injection of carbon dioxide and mixtures of carbon dioxide and effluent gases to be carried out at elevated pressures, i.e. at least about 300 psi, the overall process is still too expensive for many reservoirs.

In many instances, the minimum miscibility pressure of a subterranean hydrocarbon-bearing formation may exceed the fracture pressure of the formation thereby rendering miscible flooding impractical. At offshore locations where space is at a premium and gas plants are nonexistent, operators may be forced to reinject gas into a producing subterranean formation. Thus, a need exists for a process for preparing miscible gases for injection into a subterranean hydrocarbon-bearing formation.

It is therefore a broad object of the present invention to reduce the cost of a miscible flooding process, and a more specific object to reduce the cost of a gas enrichment process.

It is a further object of the present invention to provide a process for enriching a gas for miscible flooding where surface facilities must be minimized due to constraints on available space.

BRIEF SUMMARY OF THE INVENTION

The present invention involves preparation of an enriched gas in a simple economical manner and does not require the gas to be introduced to a subterranean formation at uneconomical high pressures. According to the invention a first gas, which is a drive gas containing no intermediate hydrocarbon compounds, is injected into a subterranean hydrocarbon-bearing formation the ambient pressure of which is less than the minimum miscibility pressure of the gas and the formation hydrocarbons. The gas is injected under ambient formation temperature and pressure conditions and is employed in an immiscible flooding operation. The formation is continued to be immiscibly displaced until gas breakthrough, after which the produced fluid is separated into oil and enriched gas. The enriched gas is mixed with the first gas and the mixture is then injected into the formation to miscibly displace the formation hydrocarbons.

The enriched gas comprises the original drive gas which has been enriched with intermediate hydrocarbons extracted from the hydrocarbons present in the formation. Preferably, the original gas is carbon dioxide, nitrogen, methane, lean natural gas or mixtures thereof. When the gas used is carbon dioxide, methane and nitrogen in the separated gas are desirably extracted prior to mixing with the first gas.

The process is simple but effective, permitting formation hydrocarbons to be produced through miscible displacement without requiring expensive operating conditions or equipment.

These and other aspects of the invention, as well as other benefits, will readily be ascertained from the more detailed description of the preferred embodiment of the invention which follows.

BRIEF DESCRIPTION OF THE DRAWINGS

The accompanying drawing, which is incorporated in and forms a part of the specification, illustrates the present invention and, together with the description, serves to explain the principles of the invention. In the drawing.

DESCRIPTION OF THE PREFERRED EMBODIMENT

Figure 1:
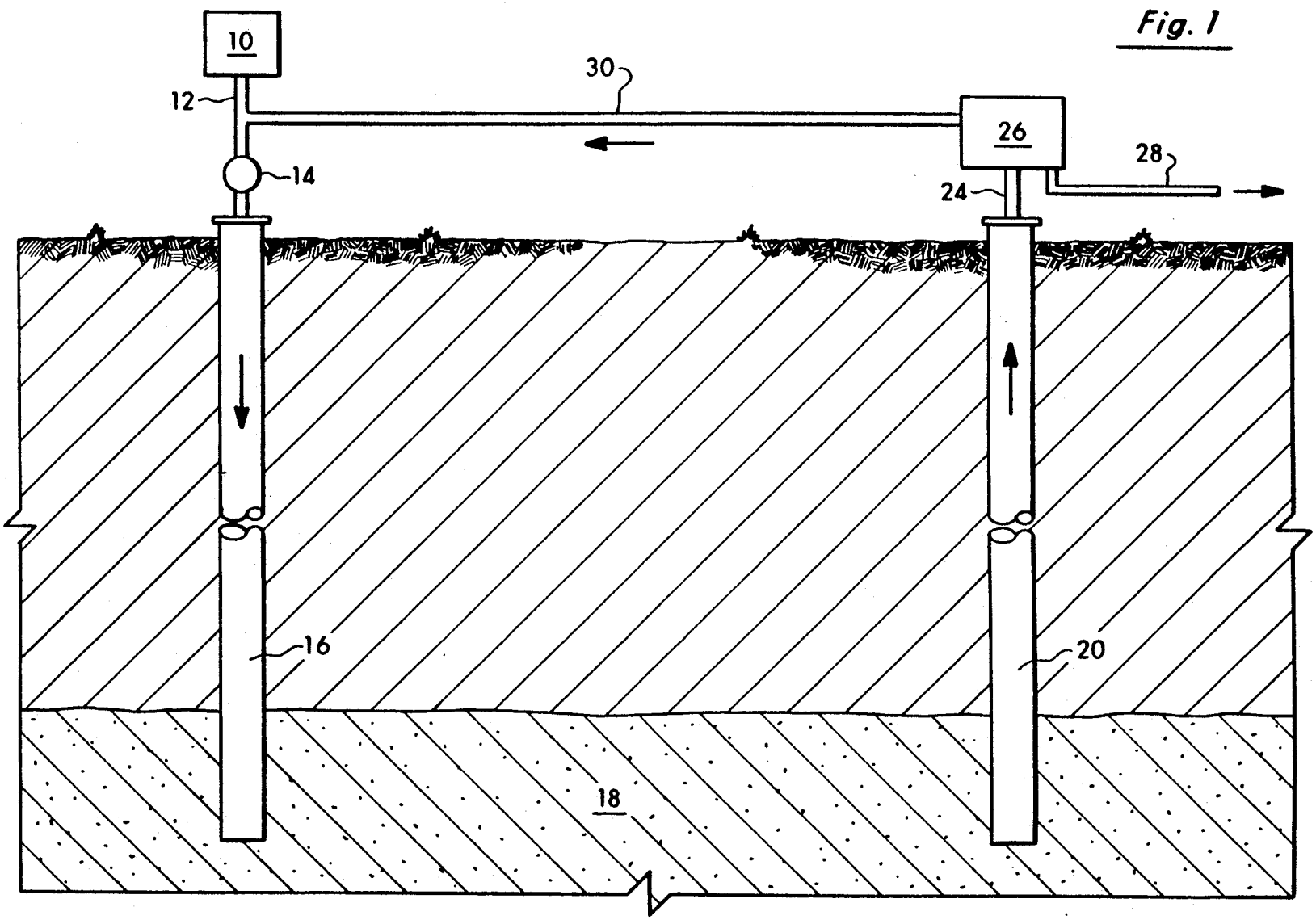
FIG. 1 is a schematic flow diagram of the gas enrichment process of the present invention.

Instead of providing expensive surface facilities and equipment to extract intermediate hydrocarbons from produced formation hydrocarbons and mix them with a drive gas prior to injecting the drive gas into a subterranean hydrocarbon-bearing formation to be produced through miscible displacement of hydrocarbons, and instead of introducing gas into the formation under high pressures in order to reach the minimum miscibility pressure of the reservoir hydrocarbons and the gas, the present invention provides for a first phase involving an immiscible flooding operation at ambient reservoir temperature and pressure. Referring to FIG. 1, a source 10 of a drive gas is delivered through conduit 12 to a pump 14 which injects the gas through the injection well 16 into the subterranean hydrocarbon-bearing formation of reservoir 18. The gas is selected such that the ambient formation pressure is less than the minimum miscibility pressure of the formation hydrocarbons and the gas, thus assuring that the flooding operation is immiscible in nature.

The gas may be any suitable gas known to function as a drive gas, such as carbon dioxide, methane, lean natural gas, or mixtures thereof, which during the process of displacing the formation hydrocarbons at the ambient pressure and temperature of the formation is capable of extracting hydrocarbon intermediate compounds from the formation hydrocarbons and thereby becoming enriched. As utilized throughout this specification, the term "lean natural gas" refers to a natural gas having at least 90 mole % methane and the terms "intermediate hydrocarbons" and "intermediate hydrocarbon compounds" are used interchangeably and each encompass those hydrocarbon compounds having from 2 to 6 carbon atoms. In this respect, the formation itself acts as a large extraction chamber. Under ambient formation conditions, however, the drive gas is not enriched sufficiently to develop miscibility with the oil.

The immiscible flooding operation continues, with formation hydrocarbons being produced through the production well 20 to surface conduit 24, until drive gas breakthrough occurs at the production well. At this time the nature of the operation changes. Referring again to FIG. 1, it will be seen that the produced formation hydrocarbons and the enriched gas are directed through conduit 24 to a separator 26 which operates under a pressure that prevents substantial loss of enrichment from the gas, i.e. at a pressure below the minimum miscibility pressure of the drive gas and the produced hydrocarbons. The separator oil resulting from this operation is delivered through line 28 for further use or sale. It will be understood that in conventional separation processes, separator oil and the produced enriched gas would be sent to a gas processing plant wherein the produced enriched gas would be separated into the original drive gas and the hydrocarbon compounds extracted from the reservoir. In this process, however, the hydrocarbon components are retained and the enriched gas is directed through line 30 to the conduit 12 and is mixed with the drive gas from the supply 10, so that a mixture of drive gas and enriched gas is injected into the reservoir 18.

The amount of enriched gas and its degree of enrichment are such that the gaseous mixture injected into the reservoir is capable of miscibly displacing the formation hydrocarbons in the formation under ambient formation pressure and temperature conditions. This is brought about by the intermediate hydrocarbon compounds transferring or condensing from the gas phase to the liquid hydrocarbon phase, and the liquid hydrocarbon phase thus becoming enriched with the hydrocarbon intermediates to develop a miscible fluid. The produced miscible fluid is separated at the separator 26, as was the produced formation hydrocarbons and enriched gas at the gas breakthrough stage of the process, and the resulting enriched gas is recycled and reinjected in the manner previously described.

As mentioned, the drive gas should be carbon dioxide, nitrogen, methane, lean natural gas or mixtures thereof. When using a drive gas containing methane, methane in the enriched gas from separator 26 will be merely additive when the enriched gas is introduced to the conduit 12. When the drive gas does not contain methane or nitrogen it will be advantageous not to mix methane or nitrogen from the enriched gas with it. In order to prevent this from occurring, the enriched gas leaving separator 26 may be directed through line 32 to an extraction vessel (not illustrated). A portion of the separator oil may also be introduced into the extraction vessel. The extraction vessel is operated under conditions, well known to those skilled in the art, to flash methane and/or nitrogen from the enriched gas. The enriched gas then is directed to the conduit 12 leading from the drive gas supply and the miscible flood process is continued as described above in connection with FIG. 1.

The following example demonstrates the practice and utility of the present invention but is not to be construed as limiting the scope thereof.

EXAMPLE

In a subterranean hydrocarbon-bearing formation having a minimum miscibility pressure measured at 5400 psi with a lean natural gas having 92 mole % methane and 8 mole % ethane and the formation hydrocarbons in accordance with the method disclosed in U.S. Pat. No. 4,610,160 and a temperature of 240° F. and pressure of 5000 psi, a lean natural gas consisting of 92 mole % methane and 8 mole % ethane is injected into the formation via an injection well in fluid communication with the formation. Formation hydrocarbons are produced from a separate production well in fluid communication with the formation. The lean natural gas is enriched with intermediate hydrocarbons during contact in situ with formation hydrocarbons. Once the enriched lean natural gas breaks through the formation and is produced together with formation hydrocarbons via the production well, the produced formation hydrocarbons and the enriched lean natural gas are transported to a separator (26). The enriched lean natural gas from the separator is determined to have a composition of 85.4 mole % methane, 7 mole % ethane, 4 mole % propane, 2 mole % butane, 1.2 mole % pentane and 0.4 mole % heptane. Since the minimum miscibility pressure of the enriched lean natural gas is measured at 4900 psi, injection of this enriched lean natural gas into the formation via the injection well should result in miscible flooding of the formation hydrocarbons.

The process of the present invention may be incorporated into conventional gas flooding operations, such as water-alternating-gas flooding of a hydrocarbon-bearing formation disclosed in U.S. Pat. No. 4,846,276 which is incorporated herein by this reference, as will be evident to the skilled artisan. Further, it is important to note that even in the instance where the process of the present invention does not result in miscible flooding in a given formation, the process may still enhance oil recovery from such formation where increased formation hydrocarbon swelling and/or viscosity reduction is achieved by the process of the present invention.

While the foregoing preferred embodiments of the invention have been described and shown, it is understood that the alternatives and modifications, such as those suggested and others, may be made thereto and fall within the scope of the invention.

What is claimed is:

1. A process for preparing enriched gas for use in miscibly displacing formation hydrocarbons present in a subterranean hydrocarbon-bearing formation, comprising the steps of:

injecting a first gas selected from the group consisting of methane, lean natural gas, nitrogen, carbon dioxide and mixtures thereof into a subterranean hydrocarbon-bearing formation at ambient formation temperature and pressure conditions via an injection well in fluid communication with the formation, the ambient formation pressure being less than the minimum miscibility pressure of the first gas with the formation hydrocarbons, and the first gas having the ability to extract intermediate hydrocarbon compounds from the formation hydrocarbons at ambient formation temperature and pressure conditions thereby becoming an enriched gas;

immiscibly displacing formation hydrocarbons with the first gas until breakthrough of the enriched gas at a production well in fluid communication with the formation;

separating the enriched gas from fluid produced via said production well after said breakthrough of the enriched gas; and mixing the enriched gas with the first gas, wherein the mixed gases are sufficiently enriched to have a minimum miscibility pressure less than the ambient formation pressure so as to be capable of miscibly displacing formation hydrocarbons in said formation under said ambient formation temperature and pressure conditions.

2. The process of claim 1, including the step of injecting the mixed gases into the formation via said injection well to miscibly displace the formation hydrocarbons.

3. The process of claim 1, wherein the first gas is a drive gas containing no intermediate hydrocarbon compounds.

4. The process of claim 1, wherein the first gas is carbon dioxide.

5. The process of claim 1, wherein the first gas is either nitrogen or carbon dioxide, and wherein the process includes the further step of extracting methane from the separated enriched gas prior to mixing the enriched gas with the first gas.

6. The process of claim 1, wherein the intermediate hydrocarbon compounds comprise hydrocarbon compounds having from 2 to 6 carbon atoms.

* * * * *